US010124479B2

(12) United States Patent
Reinhart

(10) Patent No.: US 10,124,479 B2
(45) Date of Patent: Nov. 13, 2018

(54) SAWHORSE SHELF HINGE FEATURE

(71) Applicant: Creative Plastic Concepts, LLC, Sycamore, OH (US)

(72) Inventor: Nickolas Reinhart, Findlay, OH (US)

(73) Assignee: Creative Plastic Concepts, LLC, Sycamore, OH (US)

( * ) Notice: Subject to any disclaimer, the term of this patent is extended or adjusted under 35 U.S.C. 154(b) by 138 days.

(21) Appl. No.: 15/006,180

(22) Filed: Jan. 26, 2016

(65) Prior Publication Data

US 2016/0221177 A1 Aug. 4, 2016

Related U.S. Application Data

(60) Provisional application No. 62/109,354, filed on Jan. 29, 2015.

(51) Int. Cl.
*B25H 1/06* (2006.01)
*B25H 1/12* (2006.01)

(52) U.S. Cl.
CPC ..... *B25H 1/06* (2013.01)

(58) Field of Classification Search
CPC ... B25H 1/04; B25H 1/06; B25H 1/12; B65D 43/163; E05D 5/0238; Y10S 269/90; Y10S 269/901
USPC ..... 248/166; 182/225, 153
See application file for complete search history.

(56) References Cited

U.S. PATENT DOCUMENTS 3,057,591 A * 10/1962 Weimer ..... G10G 5/00 248/166
4,113,056 A * 9/1978 DeLorenzo ..... B25H 1/06 182/153
4,432,467 A * 2/1984 Swingley, Jr. ..... B65D 43/16 220/826
4,763,757 A * 8/1988 Cheney ..... B25H 1/04 182/153

(Continued)

FOREIGN PATENT DOCUMENTS

CA 156738 S 1/2015

OTHER PUBLICATIONS

Dewalt Adjustable metal legs sawhorse_home depot canada, 2012, DWST11031, https://www.homedepot.ca/en/home/p.adjustablemetal-legssawhorse. 1001024770.html.*

*Primary Examiner* — Joseph J Hail
*Assistant Examiner* — Arman Milanian
(74) *Attorney, Agent, or Firm* — Jacob M. Ward; Ward Law Office LLC

(57) ABSTRACT

A sawhorse includes a first side body and a second side body. Each of the first side body and the second side body has a first cross member, a second cross member, a first leg portion with a foot, and a second leg portion with a foot. The first cross member of the first side body is rotatably coupled to the first cross member of the second side body. The first side body and the second side body are positionable between a closed position and an opened position. The sawhorse further includes a centrally hinged, folding platform that is rotatably coupled to the second cross member of each of the first side body and the second side body. Where in the open position, the folding platform is fully deployed to create a substantially planar surface spanning the second cross members of the first side body and the second side body.

14 Claims, 7 Drawing Sheets

(56) References Cited

U.S. PATENT DOCUMENTS 4,765,480 A * 8/1988 Malmanger ..... B65D 21/064 206/506
5,101,932 A 4/1992 Trudgeon
5,439,073 A 8/1995 Johnson
5,560,448 A * 10/1996 Yemini ..... B25H 1/06 182/153
RE35,627 E 10/1997 Estrem
D392,746 S * 3/1998 Dickinson ..... D25/67
5,954,156 A 9/1999 Cooke
D425,210 S * 5/2000 DuRapau ..... D25/67
6,164,413 A * 12/2000 Sagol ..... B25H 1/06 182/153
6,286,824 B1 * 9/2001 Sagol ..... B25H 1/04 269/900
6,422,343 B1 * 7/2002 Berg ..... B25H 1/06 182/153
6,443,481 B1 * 9/2002 Stravitz ..... A47B 31/04 211/201
6,612,401 B1 9/2003 Price et al.
D634,858 S 3/2011 Landau et al.
D638,141 S 5/2011 Busschaert et al.
8,066,143 B2 * 11/2011 Baltz ..... B65D 1/22 220/324
D708,351 S * 7/2014 Ken-Dror ..... D25/67
D722,183 S 2/2015 Reinhart
2002/0125072 A1 * 9/2002 Levy ..... B25H 1/06 182/153
2002/0158446 A1 * 10/2002 Stravitz ..... A47B 31/04 280/651
2005/0230188 A1 * 10/2005 Berg ..... B25H 1/06 182/153
2006/0254858 A1 * 11/2006 Rosewicz ..... B25H 1/06 182/153
2009/0288914 A1 * 11/2009 Landau ..... B25H 1/06 182/225
2010/0282540 A1 11/2010 Moss et al.
2013/0140110 A1 * 6/2013 Ken-Dror ..... E04G 1/32 182/18

* cited by examiner

SAWHORSE SHELF HINGE FEATURE

CROSS-REFERENCE TO RELATED APPLICATIONS

This application claims the benefit of U.S. Provisional Application No. 62/109,354, filed on Jan. 29, 2015, the entire disclosure of which is hereby incorporated herein by reference.

FIELD

The present disclosure relate generally to sawhorses and, more particularly, to folding sawhorses with shelving.

BACKGROUND

Sawhorses having fixed position legs and a centrally positioned member, such as a two-by-four stud, are well known for supporting work during cutting and assembly operations. Fixed orientation sawhorses suffer from several drawbacks, including a large footprint that makes storage and transportation of the sawhorses between worksites difficult. The use of construction materials such as lumber also adds significantly to their weight.

Folding sawhorses are also known. These sawhorses allow the legs to be moved between a stored position, having the legs abutting each other, to an extended position, having the legs spaced apart from each other. The foldability of the sawhorses resolves some of the drawbacks established above with respect to fixed position sawhorses. However, such folding sawhorses can suffer from instability, as an ability to rotate the sawhorse shelf panels requires a hinge design that does not provide for a rigid support member when the legs are extended.

There is a continuing need for a sawhorse that may be folded to a closed position for storage, but which has sufficient stability where in an opened position. Desirably, the sawhorse also permits a storage of tools and workpieces where the sawhorse is folded to the opened position.

SUMMARY

In concordance with the instant disclosure, a sawhorse that may be folded to a closed position for storage, but which has sufficient stability where in an opened position, and which also permits a storage of tools and workpieces where the sawhorse is folded to the opened position, is surprisingly disclosure.

In one embodiment, a sawhorse includes a first side body and a second side body. Each of the first side body and the second side body has a first cross member, a second cross member, a first leg portion with a foot, and a second leg portion with a foot. The first cross member of the first side body is rotatably coupled to the first cross member of the second side body. The first side body and the second side body are positionable between a closed position and an opened position. The feet of the first side body are disposed adjacent the feet of the second side body in the closed position. The feet of the first side body are spaced apart from the feet of the second side body in the opened position. The sawhorse further includes a centrally hinged, folding platform that is rotatably coupled to the second cross member of each of the first side body and the second side body. Where in the open position, the folding platform is fully deployed to create a substantially planar surface spanning the second cross member of the first side body and the second cross member of the second side body.

In another embodiment, the fingers of the first and second shelf panels are sequentially positioned, and overlap each other to define a substantially sinusoidal shaped slotted path along the folding joint. Each of the fingers including an aperture formed therethrough. The aperture has a hinge pin disposed therein, and spanning from one side to another side of the aperture. The hinge pin rotatably cooperates with one of the knuckles to form part of the hinged joint. Additionally, the second cross member of each of the first side body and the second side body may have a plurality of alternating and oppositely arranged first knuckles and second knuckles disposed on an upper surface of the second cross member. The hinge rod of each of the first and second shelf panels is rotatably coupled to one of the first side body and the second side body with the first knuckles and the second knuckles.

In a further embodiment, each of the knuckles has an adjacent recess formed in one of the first shelf panel and the second shelf panel between the inward side and the outward side. The recess has a shape corresponding to a shape of one of the fingers. The recess further having a land formed therein, and the recess and the land are configured to receive and form a positive stop for one of the fingers upon a positioning of the first side body and the second side body in the opened position.

DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION

The following detailed description and appended drawings describe and illustrate various exemplary embodiments of the invention. The description and drawings serve to enable one skilled in the art to make and use the invention and are not intended to limit the scope of the invention in any manner. In respect of the methods disclosed, the steps presented are exemplary in nature and, thus, the order of the steps is not necessary or critical.

Figure 1:
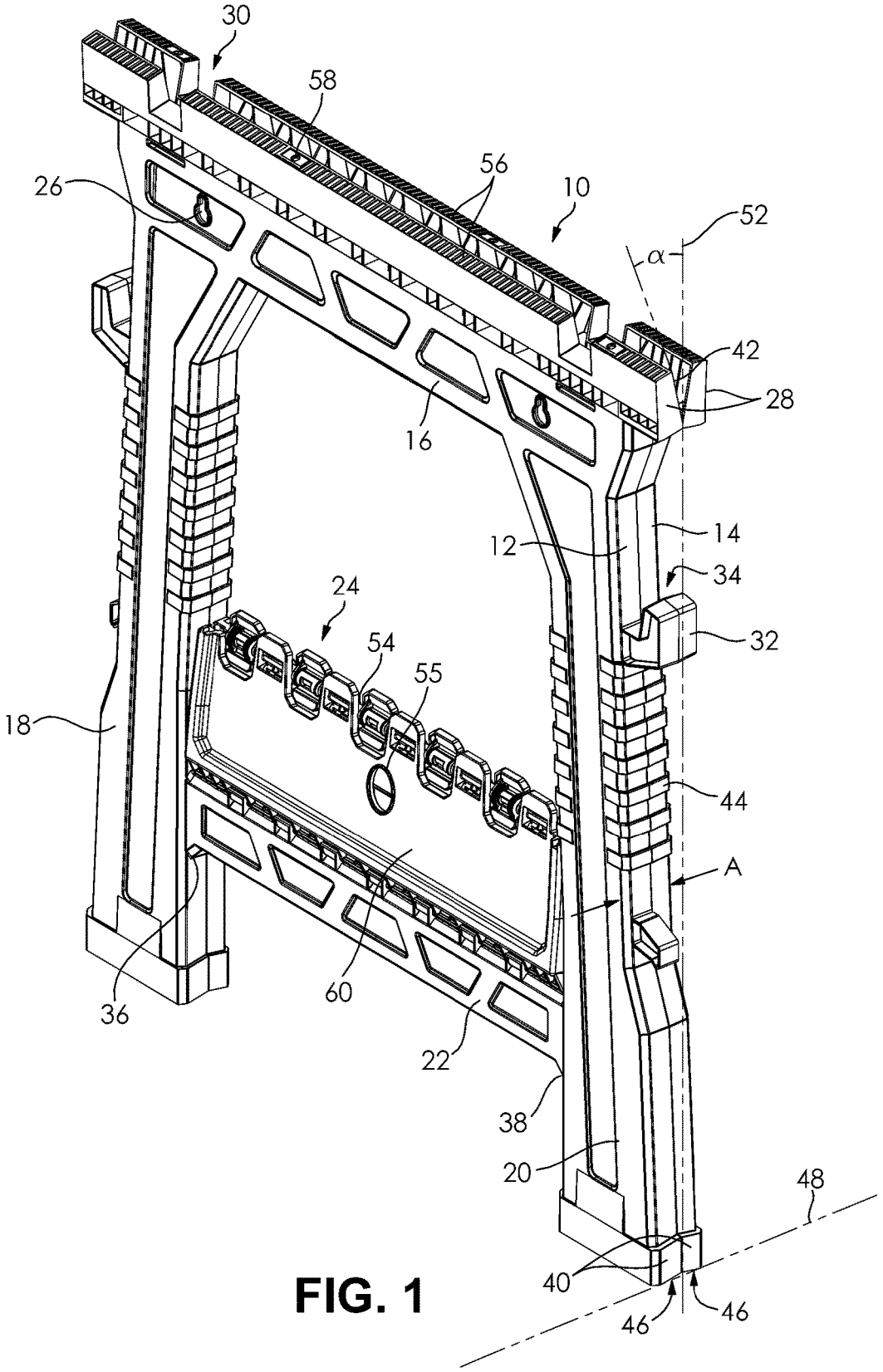
FIG. 1 is a perspective view of a sawhorse according to one embodiment of the present disclosure, and depicting the sawhorse in a fully collapsed or closed position.
Figure 2:
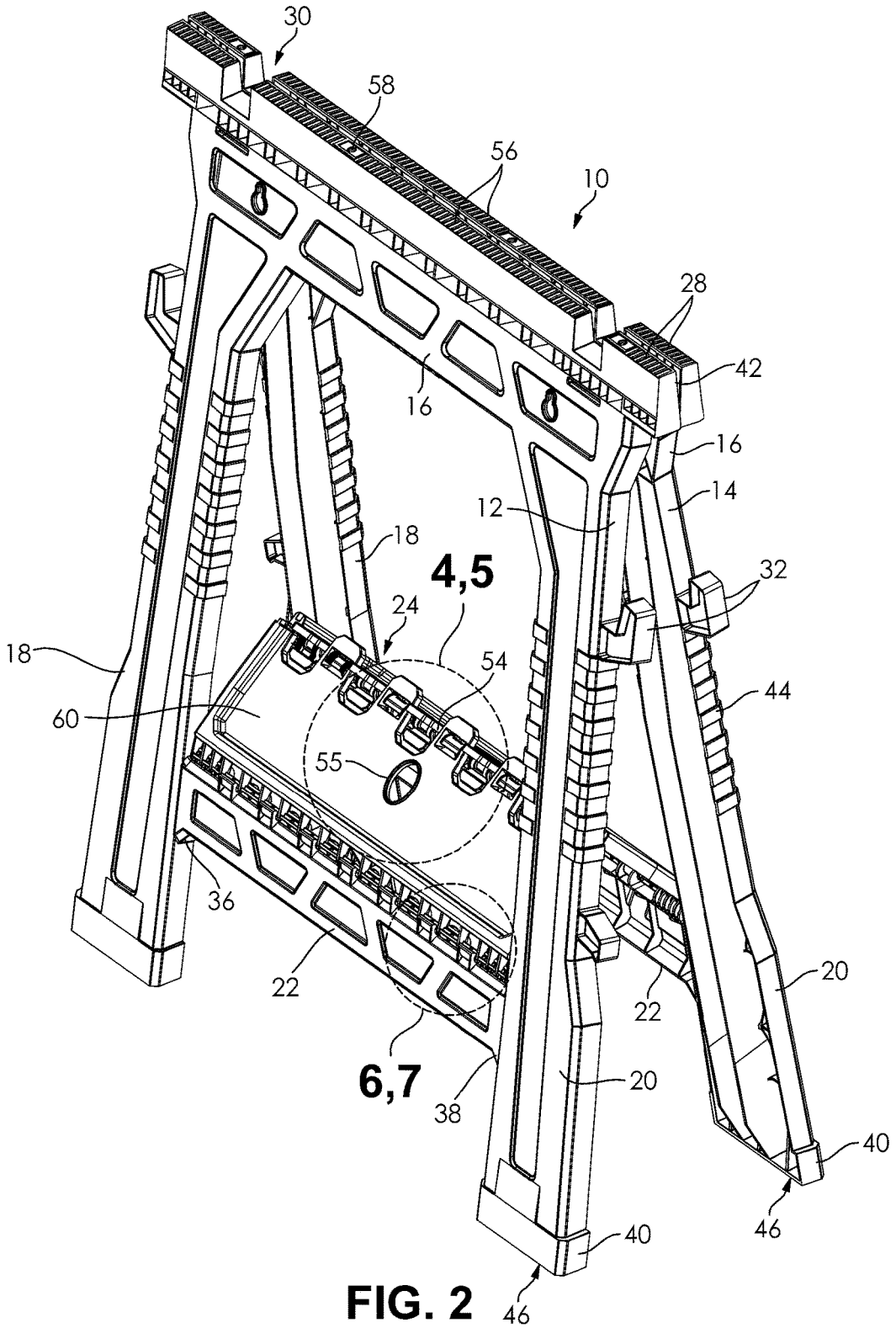
FIG. 2 is a perspective view of the sawhorse shown in FIG. 1, and depicting the sawhorse in a partially extended or opened position.
Figure 3:
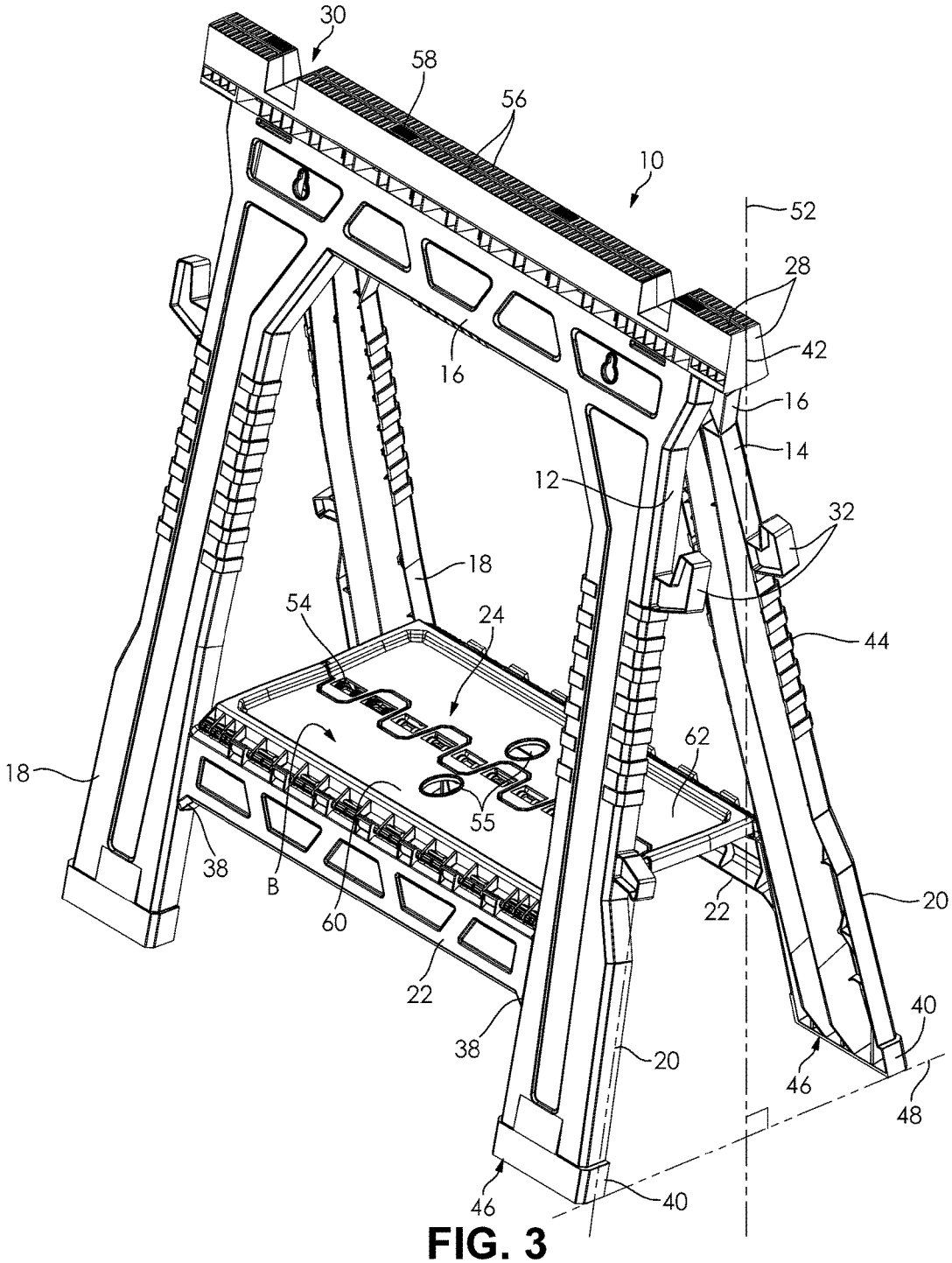
FIG. 3 is a perspective view of the sawhorse shown in FIG. 1, and depicting the sawhorse in a fully extended or opened position.

Referring to FIGS. 1-3, a sawhorse 10 according to the present disclosure has a first side body 12 rotatably coupled to a second side body 14. The first side body 12 and the second side body 14 are substantially mirror images of each other, and therefore can each be created as a polymeric material molding, for example using an injection molding process. Each of the first side body 12 and the second side body 14 include a first cross member 16 integrally connecting a first leg portion 18 to a second leg portion 20. Each of the first side body 12 and the second side body 14 also include a second cross member 16 which is oriented substantially parallel to the first cross member and is positioned below the first cross member 16 when the sawhorse 10 is in the upright and extended position shown, the second cross member 22 also integrally connecting the first leg portion 18 to the second leg portion 20. A hinged, folding platform 24 is rotatably coupled to the second cross member 22 of each of the first side body 12 and the second side body 14. In the sawhorse extended position shown, the folding platform 24 creates a planar surface oriented parallel to, but transversely positioned with respect to the second cross member 22 of each of the first side body 12 and the second side body 14.

Sawhorse 10 can further include keyhole-shaped apertures 26 created in each of the first cross members 16 of the first side body 12 and the second side body 14. Keyhole-shaped apertures 26 allow the sawhorse 10 to be suspended from fasteners (not shown) to allow storage of the sawhorse 10. Each of the first cross members 16 of the first side body 12 and the second side body 14 include a work support member 28 which provides a substantially planar upper surface in the sawhorse extended position. The work support members 28 can include at least one recess 30. The recess 30 can be used to secure objects between two or more sawhorses 10, such as pipes or tubes (not shown) to support the objects proximate to the surface of the work support member 28 for cutting. According to further embodiments, each first leg portion 18 and second leg portion 20 of the first side body 12 and the second side body 14 can further include an L-shaped member or hook 32, creating an open cavity 34 that can be used to temporarily support components (not shown) between two or more sawhorses 10.

With continued reference to FIGS. 1-3, because each of the first side body 12 and the second side body 14 are mirror images of each other, the following discussion of first side body 12 applies equally to second side body 14. First side body 12 has the second cross member 22 integrally connected at a first integral connection 36 to the first leg portion 18, and integrally connected at a second integral connection 38 to the second leg portion 20. A molded foot 40 is also integrally connected at a bottom end of each of the first leg portion 18 and the second leg portion 20. Each molded foot 40 includes a face 46 that is oriented substantially parallel to a planar floor surface 48, shown in FIGS. 1 and 3, where the first side body 12 and the second side body 14 are in the sawhorse fully extended or opened position, shown in FIG. 3.

The work support member 28 of each of the first side body 12 and the second side body 14 also has an inclined planar face 42, as particularly shown in FIGS. 1-3. Each inclined planar face 42 is angularly oriented with respect to a longitudinal axis 50 of the first side body 12 or the second side body 14 such that inclined planar faces 42 each define an angle alpha ($\alpha$) from a vertical plane 52 when the first side body 12 and the second side body 14 are positioned in the sawhorse fully collapsed or closed position, as shown in FIG. 1. Likewise, the inclined planar faces 42 of the first side body 12 and the second side body 14 are aligned with respect to the vertical plane when the first side body 12 and the second side body 14 are positioned in the sawhorse fully extended or opened position, shown in FIG. 3. When the sawhorse 10 is assembled and in the fully extended or opened position shown in FIG. 3, the inclined planar faces 42 of the first side body 12 and the second side body 14 align with and directly contact each other.

Each of the first leg portion 18 and the second leg portion 20 can further include multiple outwardly and inwardly directed raised ribs 44, also shown in FIGS. 1-3, which provide additional manual gripping surfaces for the sawhorse 10.

It should be understood that, where the sawhorse 10 is changed from the collapsed or closed position shown in FIG. 1 to a fully extended or opened position shown in FIG. 3, the folding platform 24 rotates about a folding joint 54 from an inverted V configuration to a substantially planar configuration. The folding joint 54 is moved upwardly where the sawhorse 10 is changed to the collapsed or closed position, shown in FIG. 1, such that the folding platform 24 fits within a total width "A" of the first side body 12 and the second side body 14, which abut each other in the collapsed or closed position.

To facilitate the movement of the folding platform 24 about the folding joint 54, the folding platform 24 may be provided with openings 55, which permits a user to easily grab the folding platform 24 and manually move it upwardly into the inverted V configuration, or downwardly in the substantially planar configuration, as desired. As shown in FIGS. 1-3, the openings 55 may be substantially oval in shape, and allow the insertion of the user's fingers for manual movement of the folding platform 24. The openings 55 may also be centrally disposed relative to the folding joint 54. However, one of ordinary in the art may use other suitable shapes and locations for the openings 55, as desired.

The sawhorse 10 of the present disclosure may further have a plurality of raised ridges 56 created along a length of each of the work support members 28. At least one, and according to several embodiments, multiple friction pads 58 may also be fixed along the upper edge of the work support members 28, interspaced with the raised ridges 56. The friction pads 58 can be of a softer material, for example, a rubber material, more resilient than the material, for example, a thermoplastic material, of the first and second legs 12, 14 in order to provide a gripping surface for work materials temporarily supported on sawhorse 10.

Multiple hinge members (not shown) may be used to rotatably connect the work support members 28 of the first side body 12 and the second side body 14. The hinge members 59 may be snapped together after separately molding the first side body 12 and the second side body 14, for example, to rotatably connect the first side body 12 to the second side body 14. Other means for rotatably connecting the first side body 12 and the second side body 14 of the sawhorse 10 may also be employed as desired.

With reference to FIGS. 4-13, the folding platform 24 of the present disclosure is further described. The folding platform 24 includes a first shelf panel 60 and a second shelf panel 62. Advantageously, the first and second shelf panels 60, 62 may be provided as mirror image parts, for example, and thus be formed in a same mold.

An inward side of each of the first and second shelf panels 60, 62 includes extending fingers 64, 66, such as a plurality of first fingers 64 of the first shelf panel 60, and a plurality of second finger 66 of the second shelf panel 62. The fingers 64, 66 of each of the first and second shelf panels 60, 62 are sequentially positioned along the folding joint 54. In particular, where the folding platform 24 is in a substantially planar configuration as shown in FIG. 3, the fingers 64, 66 define a substantially sinusoidal shaped slotted path 68 along the folding joint.

The first shelf panel 60 and the second shelf panel 62 also have knuckles 68, 70, such as a first knuckle 68 of the first shelf panel 60, and a second knuckle 70 of the second shelf panel 62. The first knuckles 68 of the first shelf panel 60 are rotatably coupled with the second fingers 66 of the second shelf panel 62. The second knuckles 70 of the second shelf panel 62 are rotatably coupled with the first fingers 64 of the first shelf panel 60.

In particular, referring to FIGS. 4-5 and 8-11, each of the fingers 64, 66 of the shelf panels 60, 62 may have an aperture 72 formed therein. Within the aperture is a hinge pin 74, which is coupled to the finger 64, 66 and extends from one side of the aperture 72 to another side of the aperture 72. The knuckles 68, 70 of the shelf panels 60, 62 engage the hinge pins 74 of the respective opposing fingers 64, 66, to thereby rotatably couple the first and second shelf panels 60, 62 along the folding joint 54.

Figure 4:
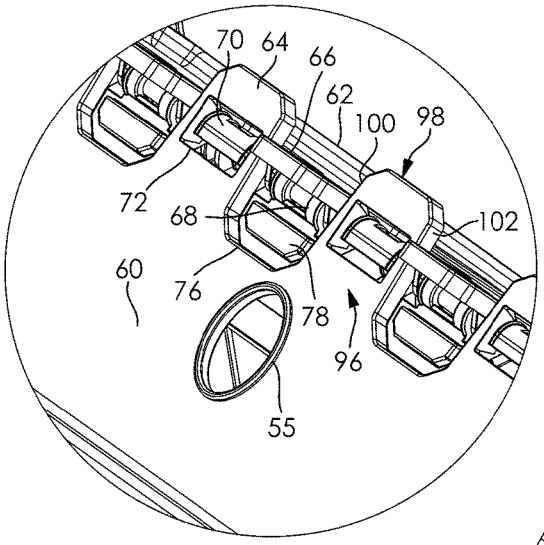
FIG. 4 is an enlarged fragmentary top perspective view taken at callout 4, 5 in FIG. 2, and depicting details of a hinged arrangement of adjoining shelf panels of the sawhorse.
Figure 8:
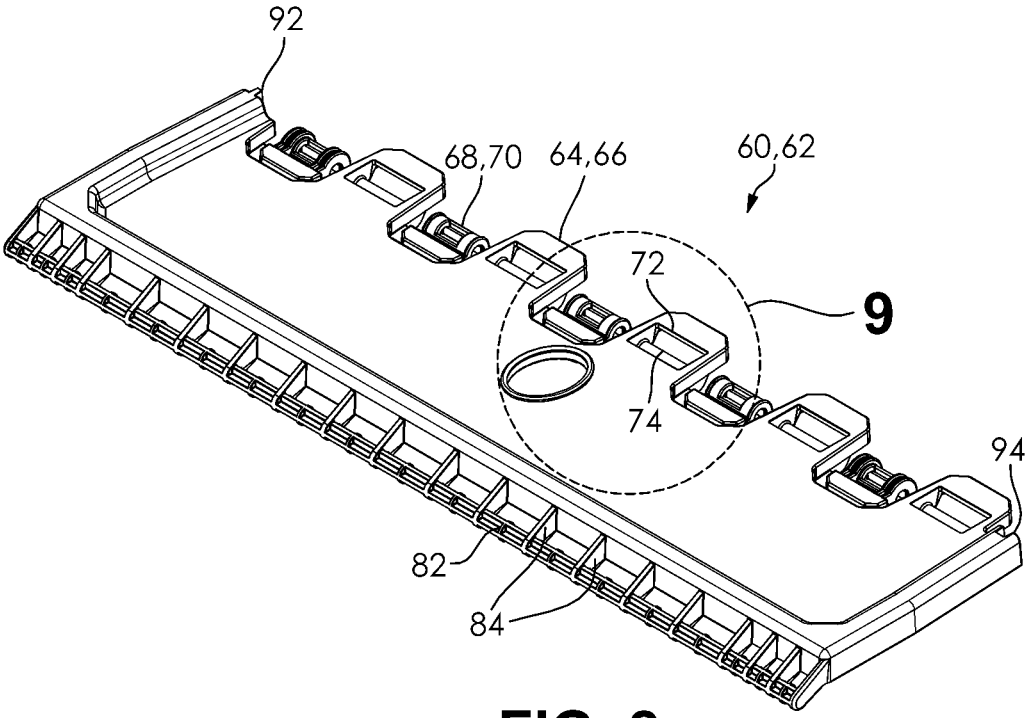
FIG. 8 is a top perspective view of one of the shelf panels shown in FIGS. 1-3.
Figure 9:
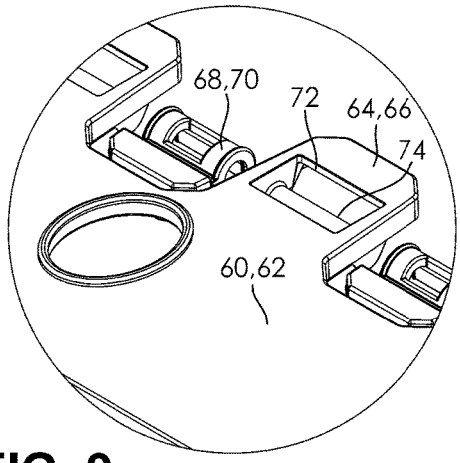
FIG. 9 is an enlarged fragmentary top perspective view taken at callout 9 in FIG. 8.

With reference to FIGS. 4 and 8-9, the shelf panels 60, 62 may further have recesses 76 formed therein. The recesses 76 are disposed adjacent to the knuckles 68, 70, and are configured to selectively receive an opposing one of the fingers 64, 66 when the shelf panels 60, 62 are assembled along the folding joint 54. Within each of the recesses 76 is further disposed a land 78. Both the recesses 76 and the lands 78 are configured to form a hard stop for the assembled shelf panels 60, 62 where moved to the fully extended or opened position, to thereby form a substantially planar surface.

Figure 5:
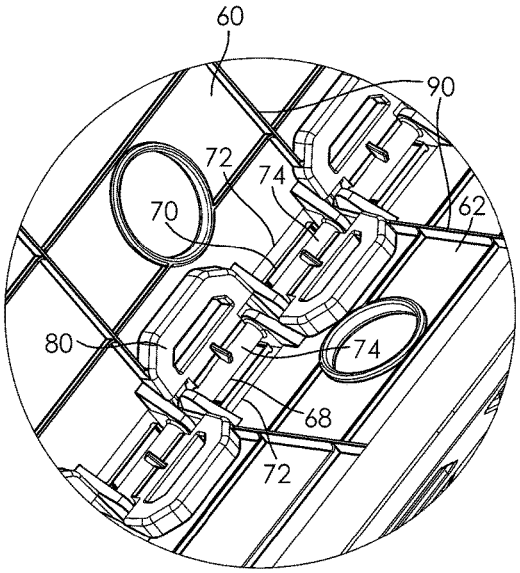
FIG. 5 is an enlarged fragmentary bottom perspective view taken at callout 4, 5 in FIG. 2, and depicting details of a hinged arrangement of adjoining shelf panels of the sawhorse.
Figure 10:
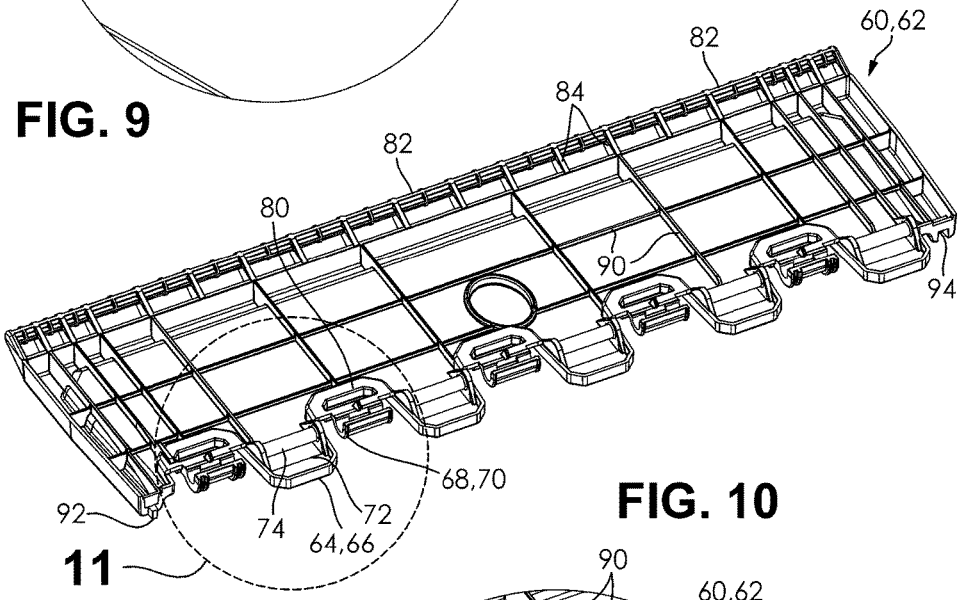
FIG. 10 is a bottom perspective view of the shelf panel shown in FIG. 8.
Figure 11:
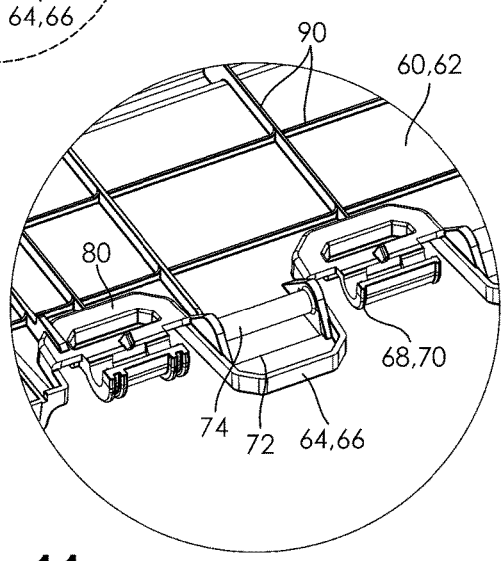
FIG. 11 is an enlarged fragmentary bottom perspective view taken at callout 11 in FIG. 10.

Referring to FIGS. 5 and 10-11, an underside of each of the first and second shelf panels 60, 62 of the folding platform 24 may have raised portions 80 that correspond in shape with the recesses 76 and lands 78 formed on a topside of the shelf panels 60, 62. As shown, the raised portions 80 may be substantially D-shaped. However, it should be appreciated that other shapes for the recesses 76, the lands 78, and the corresponding raised portions 80 may also be used, depending on the shapes of the corresponding fingers 64, 66 they are to selective receive, as desired.

With reference to FIGS. 6-8, 10, and 12-13, an outward side of each of the first and second shelf panels 60, 62 may include a hinge rod 82 connected to the shelf panel 60, 62 with a plurality of brackets 84. The hinge rod 82 may be a singular, unitary piece, as shown in FIGS. 8 and 10, or may be provided as a plurality of discrete hinge rods 82 spaced apart along the outward end of the shelf panel 60, 62, as desired.

Figure 12:
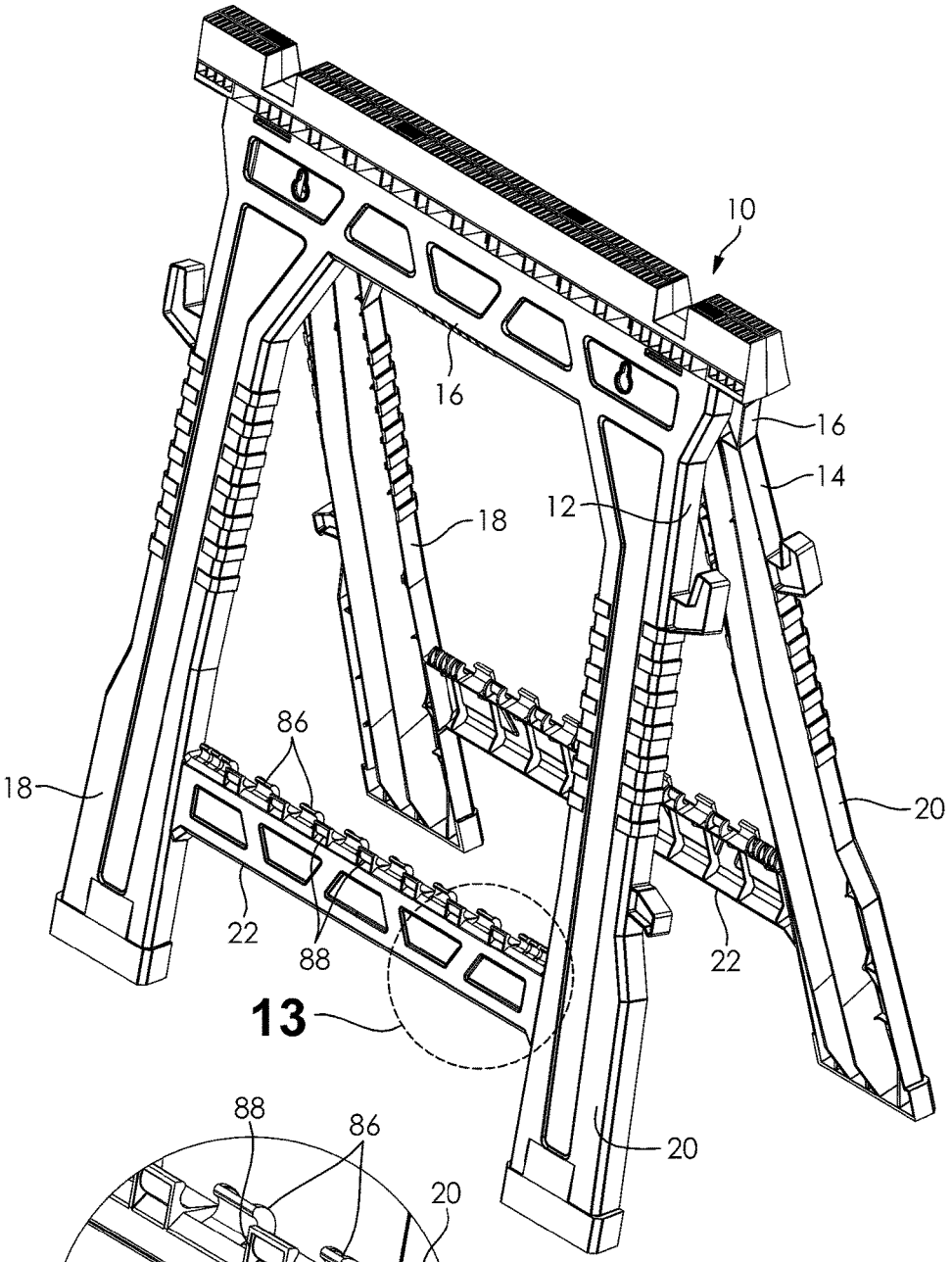
FIG. 12 is a perspective view of one side of the sawhorse shown in FIGS. 1-3, and depicting the cross members of the sawhorse without the adjoining shelf panels.
Figure 13:
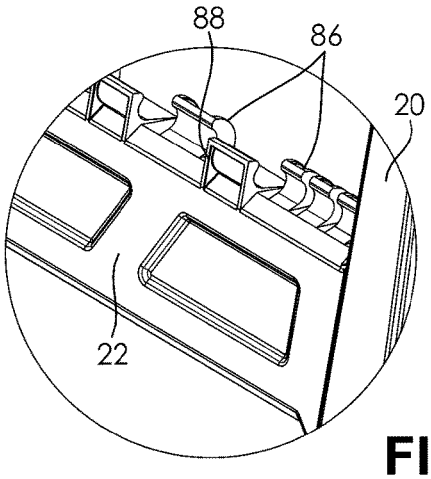
FIG. 13 is an enlarged fragmentary perspective view taken at callout 13 in FIG. 12.

As shown in FIGS. 12-13, the second cross member 22 of each of the first side body 12 and the second side body 14 may have a plurality of first knuckles 86 and a plurality of second knuckles 88. The first knuckles 86 and the second knuckles 88 are arranged opposite one another on an upper surface of the second cross member 22, and are configured to receive the hinge rod 82 of one of the shelf panels 60, 62. The first knuckles 86 and the second knuckles 88 may also be arranged in an alternating fashion along at least a portion of the upper surface of the second cross member 22, in order to facilitate an insertion of the hinge rod 82 therebetween.

Figure 6:
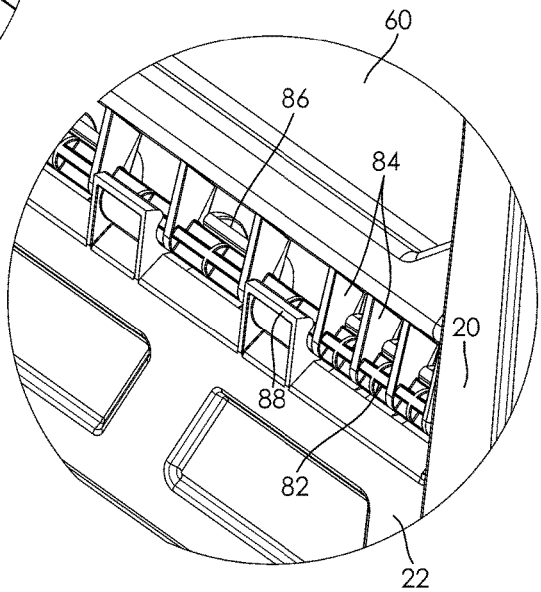
FIG. 6 is an enlarged fragmentary top perspective view taken at callout 6, 7 in FIG. 2, and depicting details of a hinged arrangement of a shelf panel and a cross member of the sawhorse.
Figure 7:
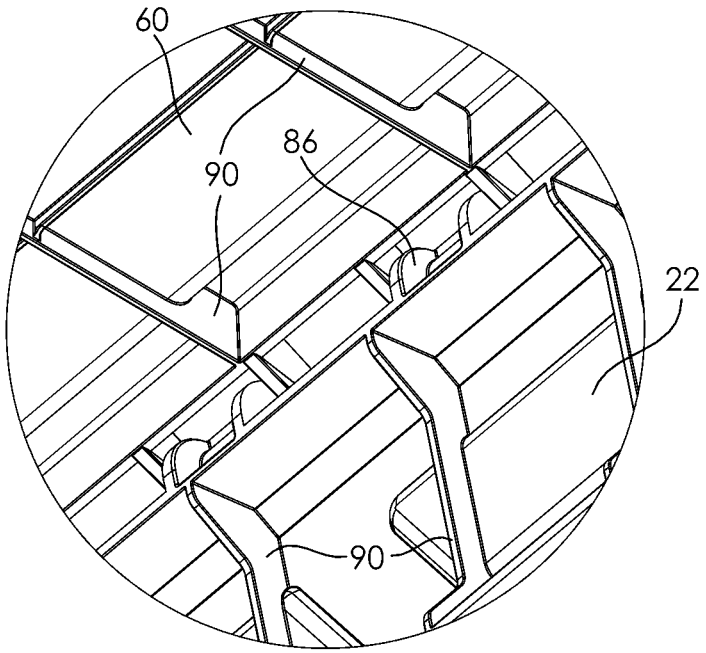
FIG. 7 is an enlarged fragmentary bottom perspective view taken at callout 6, 7 in FIG. 2, and depicting details of a hinged arrangement of a shelf panel and a cross member of the sawhorse.

In particular, and upon assembly of the sawhorse 10 as shown in FIGS. 6 and 7, the hinge rod 82 of the first panel 60 is disposed between the first knuckles 86 and the second knuckles 88, and thereby rotatably coupled with, the second cross member 22 of the first side body 12. Likewise, the hinge rod 82 of the second panel 62 is rotatable coupled with the second cross member 22 of the second side body 14 via cooperation with the first knuckles 86 and the second knuckles 88. Other suitable means for rotatable coupling the outward end of each of the first and second shelf panels 60, 62 with the second cross members 22 of the sawhorse 10 may also be employed within the scope of the disclosure.

Referring to FIGS. 5, 7, and 10-11, to minimize weight and molding material volume, each of the firs side body 12 and the second side body 14, and the first and second shelf panels 60, 62, may be provided with reinforcing ribs 90 formed on inner surfaces thereof.

With reference to FIG. 3, the folding platform 24, where the sawhorse 10 is positioned in the fully extended or opened position defines a planar surface "B". In an exemplary embodiment, planar surface "B" is oriented parallel to the planar floor surface 48. This advantageously permits the folding platform 24 to be used as a space for holding tools or work implements during use of the sawhorse 10.

Referring to FIGS. 8 and 10, it should be understood that each of the first and second shelf panels 60, 62 is provided with additional positive stop features in the form of a male portion 92 and a female portion 94. The male portion 92 and the female portion 94 are disposed on opposite ends of the shelf panels 60, 62, and configured to cooperate with an oppositely positioned male portion 92 or female portion 94 of another one of shelf panels 60, 62, where the first and second shelf panels 60, 62 are assembled together along the folding joint 54 to form the folding platform 24. The male portion 92 and the female portion 94 thereby provide a further positive stop, in addition to the positive stop provided by the fingers 64, 66 being received by the recesses 76, as described further hereinabove. Engagement of the male features 92 with the female features 94 further helps to releasably lock the first shelf panel 60 to the second shelf panel 62 against side-to-side shifting when weight loaded.

Referring to FIG. 4, to provide for rotational clearance between successive ones of the oppositely directed first and second fingers 64, 66, each of the fingers and second fingers 64, 66 shown has a base end 96 fixed to one of the first or second shelf panels 60, 62, and which is wider than an oppositely positioned free end 98. This geometry provides for tapering outer walls 100, 102 that taper inwardly between base end 96 and the free end 98.

In operation, and consistent with the structure described hereinabove, the sawhorse 10 may be moved from the fully collapsed or closed position (FIG. 1), typically used for storage or transport, through a partially extended or opened position (FIG. 2), to a fully extended or opened position (FIG. 3). In the fully collapsed or closed position, the first and second shelf panels 60, 62 are arranged in the inverted V shape and have a width that is less than a width A, shown in FIG. 1. In the fully extended or opened position, the fingers 64, 66 of the first and second shelf panels 60, 62 are aligned co-planar with each other, resulting in the a parallel alignment of the first and second shelf panels 60, 62 and the formation of the planar surface B.

Advantageously, the sawhorse 10 of the present disclosure may be folded to the closed position for storage, but has sufficient stability where in the opened position. The sawhorse 10 also permits a storage of tools and workpieces where the sawhorse 10 is folded to the opened position.

While certain representative embodiments and details have been shown for purposes of illustrating the invention, it will be apparent to those skilled in the art that various changes may be made without departing from the scope of the disclosure, which is further described in the following appended claims.

What is claimed is:

1. A sawhorse, comprising:

a first side body and a second side body, each of the first side body and the second side body having a first cross member, a second cross member, a first leg portion with a foot, and a second leg portion with a foot, the first cross member of the first side body rotatably coupled to the first cross member of the second side body, the first side body and the second side body positionable between a closed position and an opened position, the feet of the first side body disposed adjacent the feet of the second side body in the closed position, and the feet of the first side body spaced apart from the feet of the second side body in the opened position; and a folding platform with a centrally hinged folding joint, the folding platform also rotatably coupled to the second cross member of each of the first side body and the second side body, wherein the folding platform includes a first shelf panel and a second shelf panel, each of the first shelf panel and the second shelf panel having an inward side adjacent the centrally hinged folding joint and an outward side adjacent one of the first side body and the second side body, a plurality of extending fingers and plurality of knuckles disposed on and alternating along the inward side of each of the first shelf panel and the second shelf panel, and a hinge rod arranged on the outward side of each of the first shelf panel and the second shelf panel, wherein each of the extending fingers has a downwardly extending wall disposed along at least a portion of a perimeter of each of the extending fingers, and wherein each of the knuckles has an associated and adjacent recess formed in one of the first shelf panel and the second shelf panel between the inward side and the outward side, the recess having a shape corresponding to a shape of one of the fingers, and the recess further having a land formed therein, the land being a raised platform inside of the recess that together with the recess defines a groove for receiving the downwardly extending wall of the finger when the first side body and the second side body are in the opened position, wherein the recess and the land form a stop for one of the fingers upon a positioning of the first side body and the second side body in the opened position, and wherein a raised portion on an underside of one of the first shelf panel and the second shelf panel corresponds with the recess and the land on a topside of the one of the first shelf panel and the second shelf panel, and wherein each of the knuckles has an associated locking tab disposed on an underside of the knuckle adjacent to the raised portion, the locking tab overhanging an open portion of the knuckle to facilitate a snapping of a hinge pin within the knuckle, the locking tab having an angled outward edge that facilitates a sliding of the hinge pin into the knuckle.

2. The sawhorse of claim 1, wherein the fingers of the first and second shelf panels are sequentially positioned, and overlap each other to define a sinusoidal shaped slotted path along the folding joint.

3. The sawhorse of claim 1, wherein each of the fingers includes an aperture formed therethrough.

4. The sawhorse of claim 3, wherein the aperture has the hinge pin disposed therein, and spanning the aperture from one side to another side of the aperture, the hinge pin rotatably cooperating with one of the knuckles to form part of the folding joint.

5. The sawhorse of claim 1, wherein the second cross member of each of the first side body and the second side body has a plurality of alternating and oppositely arranged first knuckles and second knuckles disposed on an upper surface of the second cross member.

6. The sawhorse of claim 5, wherein the hinge rod of each of the first and second shelf panels is rotatably coupled to one of the first side body and the second side body with the first knuckles and the second knuckles.

7. The sawhorse of claim 1, wherein the raised portion is D-shaped.

8. The sawhorse of claim 1, wherein each of the first shelf panel and the second shelf panel has a male stop portion and a female stop portion, the male stop portion spaced apart from the female stop portion.

9. The sawhorse of claim 8, wherein the male stop portion and the female stop portion are arranged adjacent opposite ends of one of the first shelf panel and the second shelf panel.

10. The sawhorse of claim 1, wherein each of the fingers has a base end affixed to the inward side and an oppositely positioned free end, a width of the free end being less than a width of the base end to result in a tapering of each of the fingers.

11. The sawhorse of claim 1, wherein each of the first panel and the second panel includes an opening formed between the inward side and the outward side to facilitate a manual positioning of the first side body and the second side body between the closed position and the opened position.

12. The sawhorse of claim 1, wherein the hinge rod is connected to the outward side of one of the first shelf panel and the second shelf panel with a plurality of brackets.

13. The sawhorse of claim 1, wherein in the open position the folding platform is fully deployed to create a planar surface spanning the second cross member of the first side body and the second cross member of the second side body.

14. A sawhorse, comprising:

a first side body and a second side body, each of the first side body and the second side body having a first cross member, a second cross member, a first leg portion with a foot, and a second leg portion with a foot, the first cross member of the first side body rotatably coupled to the first cross member of the second side body, the first side body and the second side body positionable between a closed position and an opened position, the feet of the first side body disposed adjacent the feet of the second side body in the closed position, and the feet of the first side body spaced apart from the feet of the second side body in the opened position; and a folding platform with a centrally hinged folding joint, the folding platform also rotatably coupled to the second cross member of each of the first side body and the second side body, wherein the folding platform includes a first shelf panel and a second shelf panel, each of the first shelf panel and the second shelf panel having an inward side adjacent the centrally hinged folding joint and an outward side adjacent one of the first side body and the second side body, a plurality of extending fingers and plurality of knuckles disposed on and alternating along the inward side of each of the first shelf panel and the second shelf panel, and a hinge rod arranged on the outward side of each of the first shelf panel and the second shelf panel, wherein the fingers of the first and second shelf panels are sequentially positioned, and overlap each other to define a sinusoidal shaped slotted path along the folding joint, each of the fingers including an aperture formed therethrough, the aperture having a hinge pin disposed therein, and spanning the aperture from one side to another side of the aperture, the hinge pin rotatably cooperating with one of the knuckles to form part of the hinged joint, wherein the second cross member of each of the first side body and the second side body has a plurality of alternating and oppositely arranged first knuckles and second knuckles disposed on an upper surface of the second cross member, the hinge rod of each of the first and second shelf panels rotatably coupled to one of the first side body and the second side body with the first knuckles and the second knuckles, wherein each of the extending fingers has a downwardly extending wall disposed along at least a portion of a perimeter of each of the extending fingers, and wherein each of the knuckles has an associated and adjacent recess formed in one of the first shelf panel and the second shelf panel between the inward side and the outward side, the recess having a shape corresponding to a shape of one of the fingers, and the recess further having a land formed therein, the land being a raised platform inside of the recess that together with the recess defines a groove for receiving the downwardly extending wall of the finger when the first side body and the second side body are in the opened position, wherein the recess and the land form a stop for one of the fingers upon a positioning of the first side body and the second side body in the opened position, and wherein a raised portion on an underside of one of the first shelf panel and the second shelf panel corresponds with the recess and the land on a topside of the one of the first shelf panel and the second shelf panel, and wherein each of the knuckles has an associated locking tab disposed on an underside of the knuckle adjacent to the raised portion, the locking tab overhanging an open portion of the knuckle to facilitate a snapping of a hinge pin within the knuckle, the locking tab having an angled outward edge that facilitates a sliding of the hinge pin into the knuckle.

* * * * *